US009022097B2

(12) United States Patent
Takashima et al.

(10) Patent No.: US 9,022,097 B2
(45) Date of Patent: May 5, 2015

(54) METHOD AND INSTALLATION FOR MANUFACTURING THIN METAL STRIP

(71) Applicant: JFE Steel Corporation, Chiyoda-ku, Tokyo (JP)

(72) Inventors: MInoru Takashima, Tokyo (JP); Seiji Okabe, Tokyo (JP); Nobuo Shiga, Tokyo (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 14/355,725

(22) PCT Filed: Nov. 13, 2012

(86) PCT No.: PCT/JP2012/079334
§ 371 (c)(1),
(2) Date: May 1, 2014

(87) PCT Pub. No.: WO2013/073513
PCT Pub. Date: May 23, 2013

(65) Prior Publication Data

US 2014/0290900 A1 Oct. 2, 2014

(30) Foreign Application Priority Data

Nov. 14, 2011 (JP) ..... 2011-248384

(51) Int. Cl.
*B22D 11/00* (2006.01)
*B22D 11/06* (2006.01)
*B65H 20/10* (2006.01)

(52) U.S. Cl.
CPC ..... *B22D 11/062* (2013.01); *B65H 20/10* (2013.01); *B22D 11/0611* (2013.01); *B22D 11/0631* (2013.01); *B65H 2301/5144* (2013.01); *B65H 2406/122* (2013.01); *B22D 11/0682* (2013.01); *B22D 11/0694* (2013.01)

(58) Field of Classification Search
CPC .... B22D 11/00; B22D 11/0405; B22D 11/06; B22D 11/0611; B22D 11/0631; B22D 11/0642; B22D 11/0651; B22D 11/0654; B22D 11/068; B22D 11/0694
USPC ..... 164/462, 463, 479, 481, 482, 485, 418, 164/427, 433, 434, 423, 429
See application file for complete search history.

(56) References Cited

FOREIGN PATENT DOCUMENTS

BE 1000490 A4 12/1988
JP 63-174720 A 7/1988

(Continued)

OTHER PUBLICATIONS

International Preliminary Report on Patentability and Written Opinion dated May 20, 2014, application No. PCT/JP2012/079334.

(Continued)

*Primary Examiner* — Kevin P Kerns
*Assistant Examiner* — Steven Ha
(74) *Attorney, Agent, or Firm* — RatnerPrestia

(57) ABSTRACT

A method for manufacturing a thin metal strip by pouring and rapidly solidifying molten metal onto a cooling roll rotating at a high speed to form a thin metal strip having a width of 50~350 mm, blowing compression gas from substantially a tangential direction of the cooling roll toward the thin metal strip to separate the thin metal strip from the cooling roll, adsorbing the separated thin metal strip with a permeable belt of a suction type belt conveyor, and transporting to a take-up reel to wind in form of a coil, the thin metal strip is adsorbed by the belt under conditions that a nearest approaching distance L between the cooling roll and the suction type belt conveyor is 2~50 mm and a suction width S of a suction box arranged in the suction type belt conveyor is 1.2~2.5 times of a width W of the thin metal strip.

4 Claims, 2 Drawing Sheets

(56) References Cited

FOREIGN PATENT DOCUMENTS

| | | | |
|---|---|---|---|
| JP | 6-182508 | A | 7/1994 |
| JP | 9-94638 | A | 4/1997 |
| JP | 09-262646 | | 10/1997 |
| JP | 09-262648 | | 10/1997 |

OTHER PUBLICATIONS

International Search Report mailed Feb. 12, 2013 in International Application No. PCT/JP2012/079334.

METHOD AND INSTALLATION FOR MANUFACTURING THIN METAL STRIP

CROSS REFERENCE TO RELATED APPLICATIONS

This is the U.S. National Phase application of PCT/JP2012/079334, filed Nov. 13, 2012, which claims priority to Japanese Patent Application No. 2011-248384, filed Nov. 14, 2011, the disclosures of each of these applications being incorporated herein by reference in their entireties for all purposes.

FIELD OF THE INVENTION

This invention relates to a method for manufacturing a thin metal strip by rapidly solidifying molten metal with a cooling roll rotating at a high speed and an installation used in the manufacturing method.

BACKGROUND OF THE INVENTION

Rapid solidification of molten metal with a cooling roll rotating at a high speed, or so-called "rapid cooling process" has been developed as a technique for manufacturing thin metal strips. In this case, it is one of important issues that the thin metal strip manufactured at the high speed is separated from the cooling roll and transported to a take-up reel and wound in form of a coil without causing damages.

For example, as the technique of transporting and winding the thin metal strip, Patent Document 1 proposes a method of manufacturing a thin metal strip by pouring molten metal onto a cooling roll rotating at a high speed, rapidly solidifying into a thin metal strip, separating out the thin metal strip from the cooling roll, transporting to a take-up device and winding in form of a coil with the take-up device, wherein the thin metal strip is separated out from the cooling roll by blowing compression gas in a tangential direction of the cooling roll and thus the separated thin metal strip is adsorbed with a permeable belt of a suction type conveyor run from behind with respect to a transportation direction and transported to the take-up device at an adsorbed state.

In the technique of Patent Document 1, however, the thin metal strip is transported while applying tension by making the speed of the permeable belt of the suction type conveyor faster than the speed of the thin metal strip just after the separating out from the cooling roll or the strip forming speed to generate friction force between the belt and the thin metal strip. In this rapid cooling process, the high temperature molten metal is rapidly cooled, so that the temperature of the belt inevitably rises up to about 100° C. In the belt made of nylon or the like being poor in the heat resistance, therefore, the belt is deposited onto the thin metal strip to increase friction coefficient. As a result, tension applied to the thin metal strip becomes too large in the winding of the coil with the take-up reel, and there is a problem that breakage is easily caused. This problem is solved by using a stainless mesh belt, but there is inversely caused another problem that flaws are apt to be easily caused in the thin metal strip due to friction between the latter belt and the thin metal strip.

As a technique of solving such a problem, for example, Patent Document 2 proposes a method of winding thin metal strip by adsorbing a thin metal strip separated from a cooling roll with a belt of a suction type conveyor disposed in the vicinity of the cooling roll, transporting to a take-up reel and winding with the take-up reel while applying tension to the thin metal strip, wherein the tension applied to the thin metal strip is decreased to prevent breakage by making the speed of the belt of the suction type conveyor slower than the strip forming speed, and Patent Document 3 proposes a method of winding a thin metal strip by adsorbing the same thin metal strip as mentioned above by a suction type conveyor, transporting to a take-up reel, and winding with the take-up reel while applying tension to the thin metal strip, wherein a belt covered with a fluorine resin is used in the suction type conveyor to make friction small to thereby decrease tension applied to the thin metal strip.

PATENT DOCUMENTS

Patent Document 1: JP-A-H06-182508
Patent Document 2: JP-A-H09-262646
Patent Document 3: JP-A-H09-262648

SUMMARY OF THE INVENTION

By applying the techniques of Patent Documents 2 and 3 can be largely reduced the breakage of the thin metal strip or cracks exceeding 1 mm in the widthwise length. According to the inventors' researches, however, microcracks having a widthwise length (depth) of not more than 1 mm, which are generated in widthwise end portions (edge portions) of the thin metal strip at a level confirmed only by a microscope, are not solved even in the use of the above techniques. The generation of the microcracks tends to become remarkable in thin metal strips particularly having a width of not less than 250 mm.

Recently, width widening of the thin metal strip or automation of the working process is positively proceeding in the working process of manufacturing products from the thin metal strip as a starting material from a viewpoint of improvement of productivity, labor-saving and reduction of cost. However, the microcracks may be a starting point of breakage when the thin metal strip as a starting material is worked into a product, and is a cause of considerably deteriorating the productivity even if the generation frequency is low. To this end, it is strongly desired to solve the problem of the microcracks, which was conventionally treated as unimportant.

The invention is made in view of the above problems inherent to the conventional techniques and is to propose a method for manufacturing a thin metal strip in which microcracks generated in an edge portion can be largely reduced in the manufacture of the thin metal strip, particularly width-wide thin metal strip by rapid cooling process using the cooling roll and to provide a manufacturing installation used in this method.

The inventors have made various studies on investigation of causes generating microcracks and countermeasure thereof for solving the above problems. Consequently, it has been found that the microcracks generated in the edge portion can be significantly reduced by properly adjusting conditions when the thin metal strip taken out from the cooling roll is adsorbed by the suction type belt conveyor, and the invention has been accomplished.

That is, the invention includes a method for manufacturing a thin metal strip by pouring and rapidly solidifying molten metal onto an outer peripheral surface of a cooling roll rotating at a high speed to form a thin metal strip having a width W of 50~350 mm, blowing compression gas from substantially a tangential direction of the cooling roll toward the thin metal strip to separate the thin metal strip from the cooling roll, adsorbing the separated thin metal strip with a permeable belt of a suction type belt conveyor, and transporting to a take-up reel to wind in form of a coil, characterized in that the thin metal strip is adsorbed by the belt under conditions that a nearest approaching distance L between the cooling roll and the suction type belt conveyor is 2~50 mm and a suction width S of a suction box arranged in the suction type belt conveyor is 1.2~2.5 times of a width W of the thin metal strip.

The method for manufacturing a thin metal strip according to an embodiment of the invention is characterized in that the width W of the thin metal strip is 25~350 mm Also, an embodiment of the invention is an installation for manufacturing a thin metal strip, comprising a cooling roll rotating at a high speed, a hot metal pouring port having a slit nozzle of 50~350 mm in width for pouring the molten metal onto an outer peripheral surface of the cooling roll, an air nozzle for blowing compression gas from substantially a tangential direction of the outer peripheral surface of the cooling roll toward the thin metal strip to separate the thin metal strip, a suction type belt conveyor for adsorbing and transporting the separated thin metal strip with a permeable belt by sucking air with a suction box, and a take-up reel winding the transported thin metal strip in form of a coil, characterized in that a nearest approaching distance L between the cooling roll and the suction type belt conveyor is 2~50 mm and a suction width S of a suction box arranged in the suction type belt conveyor is 1.2~2.5 times of a width W of the thin metal strip.

The installation for manufacturing a thin metal strip according to an embodiment of the invention is characterized in that the width of the slit nozzle is 250~350 mm.

According to the invention, microcracks generated in an edge portion of the thin metal strip can be largely mitigated by properly adjusting the nearest approaching distance L between the cooling roll and the suction type belt conveyor and the ratio (S/W) of the suction width S of the suction box arranged in the suction type belt conveyor for transporting the thin metal strip to the take-up device to the width W of the thin metal strip separated from the cooling roll.

DETAILED DESCRIPTION OF EMBODIMENTS OF THE INVENTION

Figure 1:
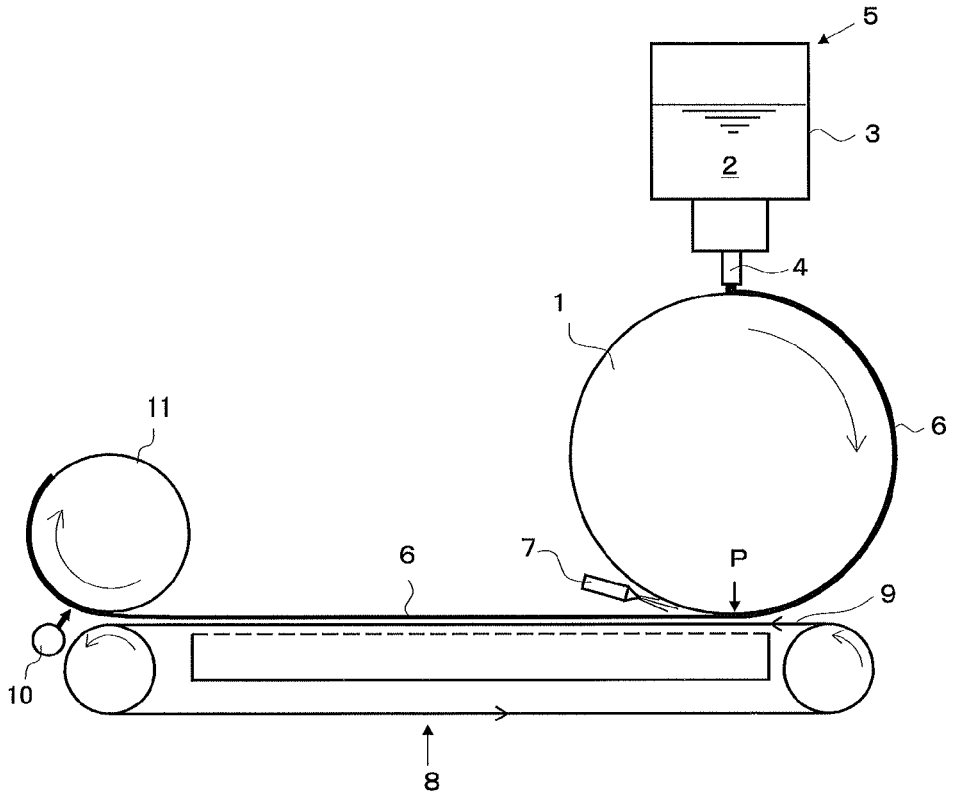
FIG. 1 is a view illustrating an outline of an installation for manufacturing a thin metal strip by rapid cooling process.

FIG. 1 shows an outline of an installation for manufacturing a thin metal strip through a single roll system used in an embodiment of the invention. In this figure, numeral 1 is a cooling roll made of a copper alloy. Above the cooling roll 1 is disposed a hot metal pouring port 5 having a molten metal holding vessel 3 for reserving molten metal 2 (hot metal) adjusted to a given chemical composition and a slit nozzle 4 arranged at a lower portion thereof and having an opening of a width W. The hot metal is poured from the slit nozzle 4 onto an upper part of an outer peripheral surface of the cooling roll 1 rotating at a high speed and rapidly solidified to form a thin metal strip 6 of a width W. Then, compression gas is jetted from an air nozzle 7 having a slit-like opening directed to a tangential direction of the outer peripheral surface of the cooling roll 1 toward the thin metal strip 6 formed on the outer peripheral surface of the cooling roll 1 to separate the thin metal strip 6 at a separation point P of the cooling roll 1. Thereafter, the separated thin metal strip 6 is adsorbed with a permeable belt 9 of a suction type belt conveyor 8 (which may be called as "conveyor" simply hereinafter) disposed beneath the separation point P and having a running start point from behind the separation point P in the transportation direction of the thin metal strip 6 and transported to a termination of the conveyor at an adsorbed state, at where the strip is guided through a pressing roll 10 to a take-up reel 11 and wound in form of a coil.

Figure 2:
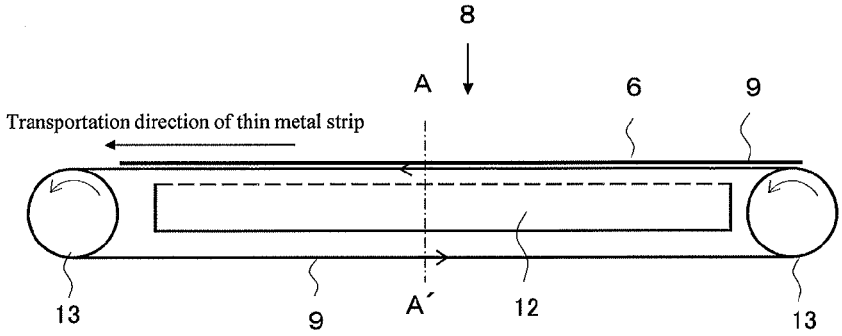
FIG. 2 is a view illustrating a suction type belt conveyor in an installation for manufacturing a thin metal strip according to an embodiment of the invention.
Figure 3:
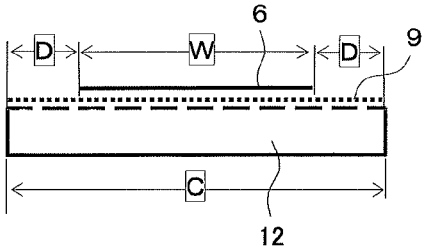
FIG. 3 is a section view taken along a line A-A' in the installation of FIG. 2.

As shown in FIG. 2, the suction type conveyor 8 is constituted with a belt 9 having an air permeability, transporting rolls 13, a suction box 12 and a vacuum pump (not shown), wherein the thin metal strip 6 separated from the cooling roll 1 is adsorbed from a right-side upper part of the figure onto an upper face of the permeable belt 9 by sucking air above the suction box 12 through the vacuum pump. FIG. 3 is a section view taken along a line A-A' of FIG. 2, in which the upper face of the suction box 12 has holes capable of sucking air without sucking the belt in the interior of the suction box. Moreover, the width C of the suction box is common to be designed so as to be made larger than the width W of the thin metal strip.

The inventors have made investigations on the mechanism of generating microcracks in the edge portion of the thin metal strip when the thin metal strip is manufactured with the above installation. Consequently, it has been found out that the microcracks are caused when the thin metal strip is adsorbed with the belt of the conveyor and by minute vibration of the thin metal strip generated in the adsorption. Furthermore, the mechanism of generating minute vibration is examined and is clear to be largely influenced by the width C of the suction box disposed in the conveyor and the width W of the thin metal strip.

Namely, when the width W of the thin metal strip is narrower as compared with the width C of the suction box disposed in the conveyor and the difference between both widths is small, concretely when the ratio (C/W) of the width C of the suction box to the width W of the thin metal strip is less than 1.2, the inflow velocity of air sucked from a gap D formed on each widthwise end portion of the suction box as shown in FIG. 3 becomes larger. As a result, turbulence of air is caused in the edge portion of the thin metal strip and minute vibration is generated in the edge portion of the thin metal strip to cause microcracks.

While when the difference between the width C of the suction box and the width W of the thin metal strip is large and the gap D formed in each widthwise end portion is large, concretely when the ratio (C/W) of the width C of the suction box to the width W of the thin metal strip exceeds 2.5, the inflow velocity of air sucked becomes small but the volume of air flown becomes larger, so that it is difficult to ensure negative pressure in the suction box and suction force is decreased. As a result, minute vibration is generated in the thin metal strip to cause microcracks in the edge portion.

In an embodiment of the invention, therefore, the width C of the suction box disposed in the conveyor is limited to a range of 1.2~2.5 times of the width W of the thin metal strip (C/W=1.2~2.5). Preferably, C/W is a range of 1.2~1.5. Moreover, the width W of the thin metal strip may be considered to be substantially equal to an opening width of the slit nozzle pouring the hot metal onto the cooling roll.

Figure 4:
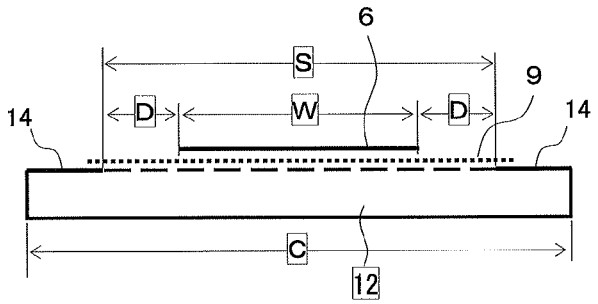
FIG. 4 is a view taken along another line A-A' in the installation of FIG. 2.

In case of the suction box shown in FIG. 3, it is necessary to change the width C of the suction box in accordance with the change in the width W of the thin metal strip in order to provide C/W value of 1.2~2.5. However, the replacement of the suction box every the change in the width W of the thin metal strip considerably obstructs the operating efficiency. As shown in FIG. 4, therefore, it is preferable that the width of the suction box is made larger and a seal width of each widthwise end portion 14 is variable and hence the seal width is changed in accordance with the change in the width W of the thin metal strip to vary a width of hole portion effective for sucking air (suction width) S. In this case, S/W is sufficient to be a range of 1.2~2.5 instead of C/W. Accordingly, when the full width C of the suction box is a portion effective for sucking air, C/W=S/W is a range of 1.2~2.5.

The inventors have found that the generation of minute vibration and hence the occurrence of microcracks is influenced by nearest approaching distance L between the cooling roll and the suction type belt conveyor in addition to the relation between the width C of the suction box or the suction width S of the suction box and the width W of the thin metal strip and the nearest approaching distance L is necessary to be controlled to a range of 2~50 mm. Here, the term "nearest approaching distance L between the cooling roll and the suction type belt conveyor" means a minimum distance between the outer periphery of the cooling roll and the surface of the suction type belt conveyor shown in FIG. 5.

Figure 5:
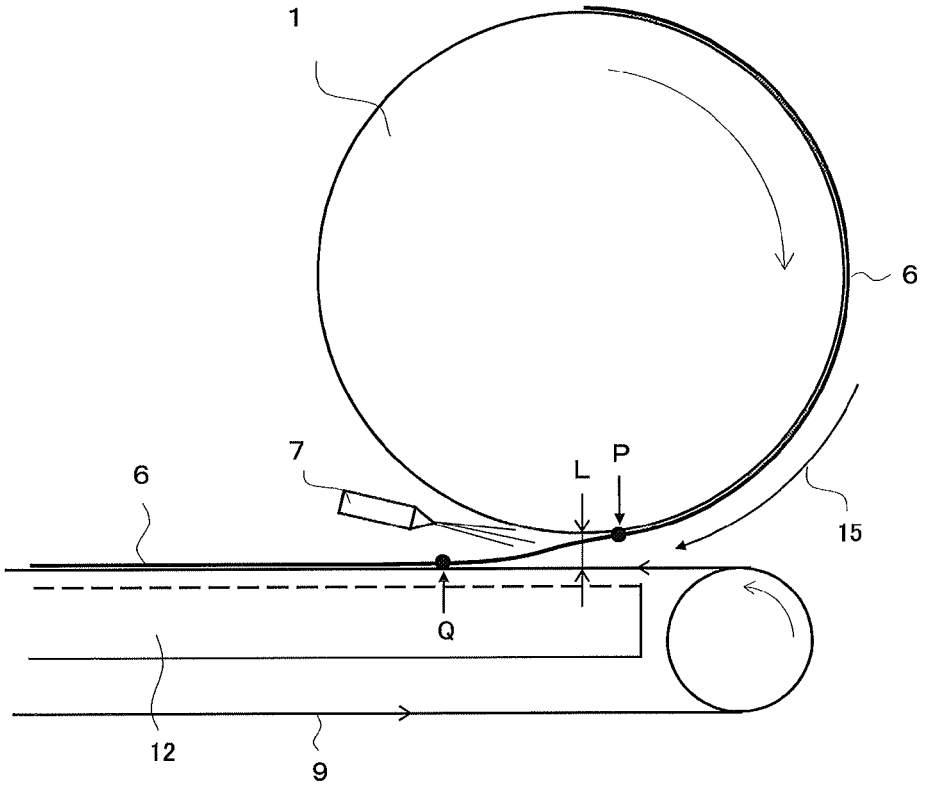
FIG. 5 is a view illustrating a positional relation between a cooling roll and a suction type belt conveyor.

When the nearest approaching distance L between the cooling roll and the conveyor is less than 2 mm, as shown in FIG. 5, air existing around the cooling roll rotating at a high speed and flowing with the rotation of the roll is compressed between the cooling roll and the conveyor. As a result, the compressed air comes under the thin metal strip and hence the thin metal strip is not adsorbed with the belt and becomes unstable to cause minute vibration. While when the nearest approaching distance L between the cooling roll and the conveyor exceeds 50 mm, the distance between separation point P of the thin metal strip and adsorption point Q of the belt shown in FIG. 5 becomes too large and the thin metal strip becomes unstable to cause minute vibration and generate microcracks.

In an embodiment of the invention, therefore, the nearest approaching distance L between the cooling roll and the conveyor is limited to a range of 2~50 mm in addition that the S/W is limited to a range of 1.2~2.5. Preferably, L is a range of 2~15 mm.

In the installation for manufacturing the thin metal strip shown in FIG. 1, the thin metal strip transported with the suction type belt conveyor is guided through the pressing roll 10 to the take-up reel 11 and wound in form of a coil, but a method other than this winding system may be used. For example, after the outer periphery of the take-up reel is coated with an adhesion material, it is contacted with the thin metal strip while rotating in synchronization with the forming speed of the thin metal strip (strip forming speed), whereby the strip may be adhered to and wound with the reel. Alternatively, there may be used a method of approaching and adsorbing the thin metal strip to the take-up reel provided on its base portion with a magnet, a method of guiding the strip to the take-up reel provided on its base portion with a magnet by tilting a final part of the conveyor and so on.

After the winding is started by the take-up reel, the suction by the suction box in the suction type belt conveyor or the transportation of the thin metal strip with the belt may be stopped.

Also, if some measuring device or the like is arranged between the cooling roll and the take-up reel during the winding, the suction type belt conveyor may be withdrawn from the illustrated position by means of a withdrawing device (not shown) in order to avoid interference with the suction type belt conveyor.

Furthermore, if the spacing between the cooling roll and the take-up reel is large, two or more suction type conveyors may be arranged in series.

As previously mentioned, the microcracks to be solved in the invention tend to become remarkable in thin metal strips having a width of not less than 250 mm. Therefore, it is preferable to apply the invention to the manufacture of the thin metal strips having a wide width of not less than 250 mm.

EXAMPLE

An experiment of manufacturing a thin metal strip with a chemical composition comprising C: 1.2 at %, Si: 8.7 at %, B: 9 at % and the remainder being substantially Fe is conducted using an installation for the manufacture of thin metal strip shown in FIG. 1 having a suction box of a structure shown in FIG. 4. Concretely, molten metal having the above chemical composition and heated to a temperature of 1320° C. is kept in a hot metal keeping vessel, poured from a slit nozzle arranged in the lower part of the hot metal keeping vessel onto an outer peripheral surface of a copper alloy cooling roll rotating sat a high peripheral speed of 30 m/s and rapidly solidified to form a thin metal strip having a thickness of 25 μm. Thereafter, compression air is blown to the thin metal strip from an air nozzle directing substantially to a tangential direction of the outer peripheral surface of the cooling roll at 30 m/s to separate the thin metal strip from the outer peripheral surface of the cooling roll. Then, the separated thin metal strip is adsorbed with a permeable belt of a suction type belt conveyor disposed below the cooling roll, transported to a take-up reel disposed in a termination of the conveyor at an adsorbed state and wound through a pressing roll to the take-up reel in form of a coil.

In this case, as shown in Table 1, an opening width of the slit nozzle pouring hot metal or a width W of the thin metal strip is changed to three levels of 100 mm, 200 mm and 300 mm, while a suction width S of the suction box is changed within a range of 100-900 mm, whereby a ratio (S/W) of the suction width S to the width W of the thin metal strip is variously changed. Also, a nearest approaching distance L between the cooling roll and the conveyor is changed between 0.5 and 80 mm.

With respect to the thus obtained thin metal strip, both edges are observed over a length of 1 m by means of a microscope to examine the presence or absence of generating microcracks with a widthwise length (earing depth) of not more than 1 mm. Moreover, cracks of not less than 0.1 mm can be confirmed in this microscope observation.

The above examination results are shown in Table 1 together with the width W of the thin metal strip, suction width S, S/W and nearest approaching distance L between cooling roll and conveyor. From Table 1, it is confirmed that the generation of microcracks in the edge portion of the thin metal strip can be prevented by making the ratio (S/W) of suction width S of the suction box to opening width of slit nozzle (=width of thin metal strip) W to a range of 1.2~2.5, whereas even when S/W is made to the above range, the generation of microcracks cannot be prevented unless the nearest approaching distance L between the cooling roll and the conveyor is made to a range of 2~50 mm.

TABLE 1

| No. | Thin strip width W (mm) | Suction width S (mm) | S/W | Distance L between cooling roll and conveyor | Presence or absence of generating microcracks | Remarks |
|---|---|---|---|---|---|---|
| | Manufacturing conditions | | | | | |
| 1 | 100 | 100 | 1.0 | 5.0 | presence | Comparative Example |
| 2 | 100 | 110 | 1.1 | 5.0 | presence | Comparative Example |
| 3 | 100 | 120 | 1.2 | 5.0 | absence | Invention Example |
| 4 | 100 | 150 | 1.5 | 5.0 | absence | Invention Example |
| 5 | 100 | 200 | 2.0 | 5.0 | absence | Invention Example |
| 6 | 100 | 250 | 2.5 | 5.0 | absence | Invention Example |
| 7 | 100 | 280 | 2.8 | 5.0 | presence | Comparative Example |
| 8 | 100 | 300 | 3.0 | 5.0 | presence | Comparative Example |
| 9 | 300 | 300 | 1.0 | 10.0 | presence | Comparative Example |
| 10 | 300 | 360 | 1.2 | 10.0 | absence | Invention Example |
| 11 | 300 | 450 | 1.5 | 10.0 | absence | Invention Example |
| 12 | 300 | 750 | 2.5 | 10.0 | absence | Invention Example |
| 13 | 300 | 900 | 3.0 | 10.0 | presence | Comparative Example |
| 14 | 200 | 300 | 1.5 | 0.5 | presence | Comparative Example |
| 15 | 200 | 300 | 1.5 | 1.0 | presence | Comparative Example |
| 16 | 200 | 300 | 1.5 | 2.0 | absence | Invention Example |
| 17 | 200 | 300 | 1.5 | 10.0 | absence | Invention Example |
| 18 | 200 | 300 | 1.5 | 50.0 | absence | Invention Example |
| 19 | 200 | 300 | 1.5 | 80.0 | presence | Comparative Example |
| 20 | 50 | 75 | 1.5 | 10.0 | absence | Invention Example |
| 21 | 350 | 420 | 1.2 | 15.0 | absence | Invention Example |

DESCRIPTION OF REFERENCE SYMBOLS

1: cooling roll
2: molten metal (hot metal)
3: hot metal keeping vessel
4: slit nozzle
5: hot metal pouring portion
6: thin metal strip
7: air nozzle
8: suction type belt conveyor
9: permeable belt
10: pressing roll
11: take-up reel
12: suction box
13: transporting roll
14: seal changeable part of each widthwise end portion
15: air flow in the vicinity of outer peripheral surface of cooling roll
W: width of thin metal strip (opening width of slit nozzle)
C: width of suction box
S: suction width of suction box
P: separation point of thin metal strip
Q: adsorption point of thin metal strip
L: nearest approaching distance between cooling roll and conveyor

The invention claimed is:

1. A method for manufacturing a thin metal strip comprising:

pouring and rapidly solidifying molten metal onto an outer peripheral surface of a cooling roll rotating at a high speed to form a thin metal strip having a width of 50-350 mm, blowing compression gas from substantially a tangential direction of the cooling roll toward the thin metal strip to separate the thin metal strip from the cooling roll, adsorbing the separated thin metal strip with a permeable belt of a suction type belt conveyor, and transporting to a take-up reel to wind in form of a coil, wherein the thin metal strip is adsorbed by the belt under conditions that a nearest approaching distance L between the cooling roll and the suction type belt conveyor is 2-50 mm and a suction width S of a suction box arranged in the suction type belt conveyor is 1.2-2.5 times of a width W of the thin metal strip.

2. The method for manufacturing a thin metal strip according to claim 1, wherein the width W of the thin metal strip is 250-350 mm.

3. An installation for manufacturing a thin metal strip, comprising:

a cooling roll rotating at a high speed, a hot metal pouring port having a slit nozzle of 50-350 mm in width for pouring the molten metal onto an outer peripheral surface of the cooling roll, an air nozzle for blowing compression gas from a substantially tangential direction of the outer peripheral surface of the cooling roll toward the thin metal strip to separate the thin metal strip, a suction type belt conveyor for adsorbing and transporting the separated thin metal strip with a permeable belt by sucking air with a suction box, and a take-up reel winding the transported thin metal strip in form of a coil, wherein a nearest approaching distance L between the cooling roll and the suction type belt conveyor is 2-50 mm and a suction width S of a suction box arranged in the suction type belt conveyor is 1.2-2.5 times of a width W of the thin metal strip.

4. The installation for manufacturing a thin metal strip according to claim 3, wherein the width of the slit nozzle is 250-350 mm.

* * * * *

UNITED STATES PATENT AND TRADEMARK OFFICE

CERTIFICATE OF CORRECTION

PATENT NO. : 9,022,097 B2
APPLICATION NO. : 14/355725
DATED : May 5, 2015
INVENTOR(S) : Minoru Takashima et al.

It is certified that error appears in the above-identified patent and that said Letters Patent is hereby corrected as shown below:

On the Title Page, item [72], Inventors: "MInoru Takashima" should read --Minoru Takashima--

Signed and Sealed this
Fifth Day of April, 2016

Michelle K. Lee

Michelle K. Lee
*Director of the United States Patent and Trademark Office*